United States Patent [19]

Taylor

[11] Patent Number: 4,548,041

[45] Date of Patent: Oct. 22, 1985

[54] ELECTRICALLY OPERATED VALVE, PISTON AND CYLINDER ASSEMBLY INCORPORATING SAID VALVE, AND SELF-CONTAINED SYSTEM INCLUDING PRESSURIZED FLUID AND HYDRAULIC ACTUATOR

[75] Inventor: Paul H. Taylor, Grand Island, N.Y.

[73] Assignee: Tayco Developments, Inc., North Tonawanda, N.Y.

[21] Appl. No.: 569,778

[22] Filed: Jan. 10, 1984

[51] Int. Cl.[4] ..... F01B 29/08; F02N 13/00

[52] U.S. Cl. ..... 60/632; 60/371

[58] Field of Search ..... 60/516, 670, 721, 527, 60/530, 531, 528, 371, 632

[56] References Cited

U.S. PATENT DOCUMENTS

| | | | |
|---|---|---|---|
| 1,697,432 | 1/1929 | Martin | 60/528 |
| 2,787,118 | 4/1957 | Markham | 60/528 |
| 3,625,002 | 12/1971 | Davis | 60/528 |
| 3,890,784 | 6/1975 | Tabeue | 60/516 |

*Primary Examiner*—Allen M. Ostrager
*Attorney, Agent, or Firm*—Joseph P. Gastel

[57] ABSTRACT

An electrically operated valve assembly including a valve member maintained on a seat by a tensioned wire or filament which is heated to permit the valve member to move off of its seat. A piston and cylinder assembly including a conduit therein for permitting pressurized fluid to actuate the piston when an electrically operated valve of the type described above is actuated. A self-contained system including a reservoir, compressible liquid in the reservoir, a squib for pressurizing the compressible liquid, a piston and cylinder, a conduit between the reservoir and the cylinder, and a valve of the above-described type in the conduit for selectively admitting pressurized compressed liquid to the cylinder. A piston and cylinder system including a plurality of the above-described valve assemblies and associated conduits for selectively admitting hydraulic liquid to opposite sides of the piston to move it in opposite directions.

9 Claims, 6 Drawing Figures

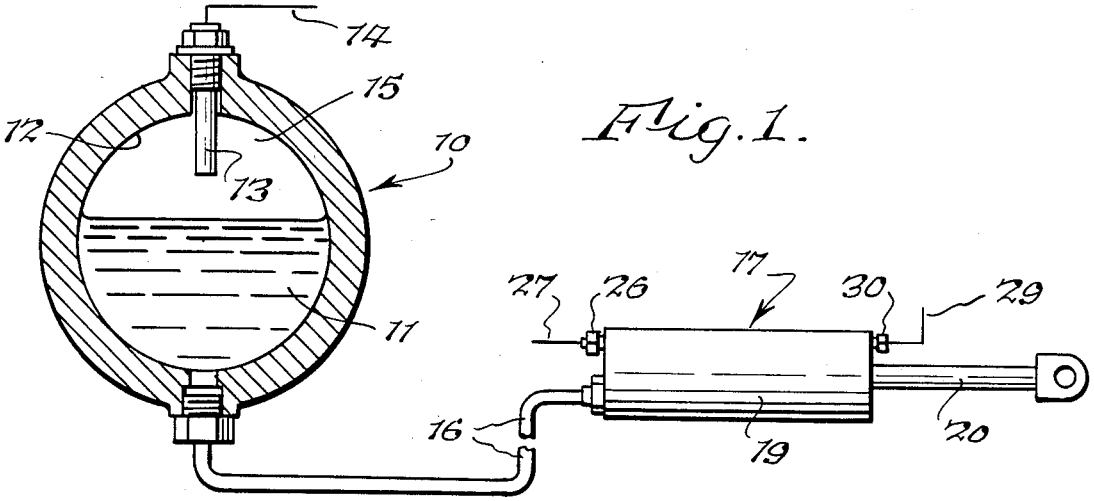
Fig. 1.
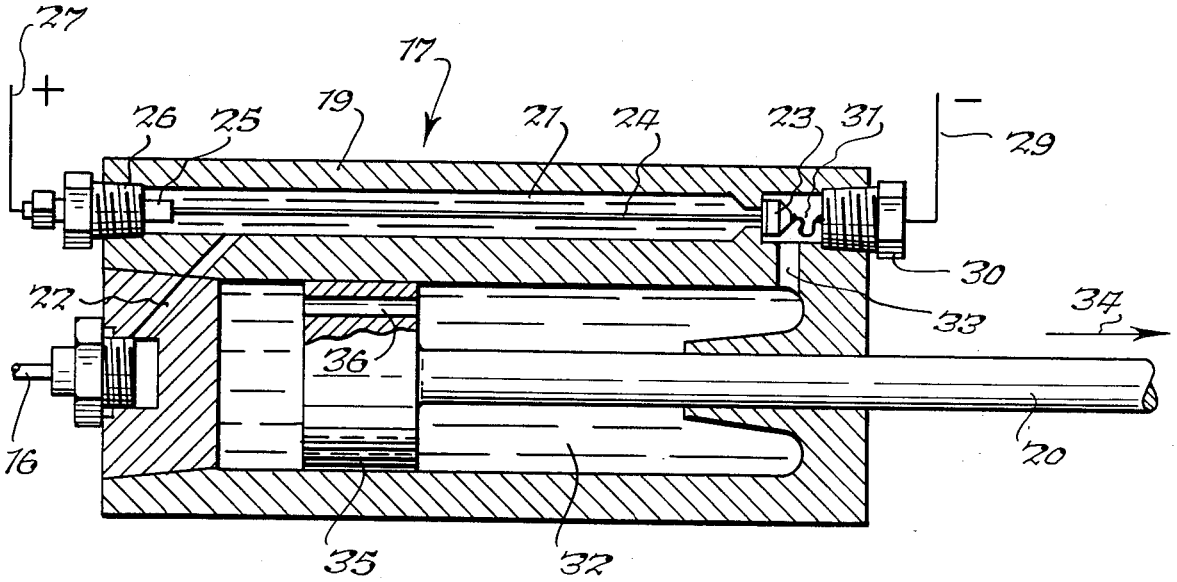
Fig. 2.
Fig. 2A.
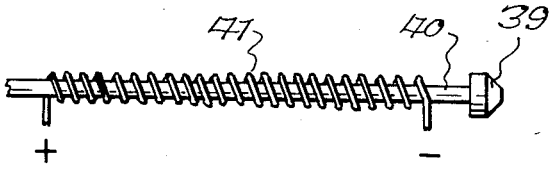
Fig. 2B.
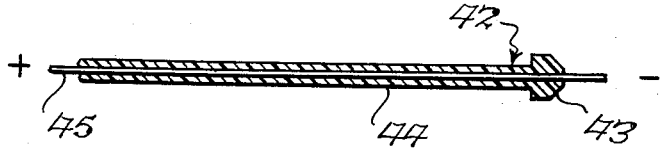

Fig. 3.
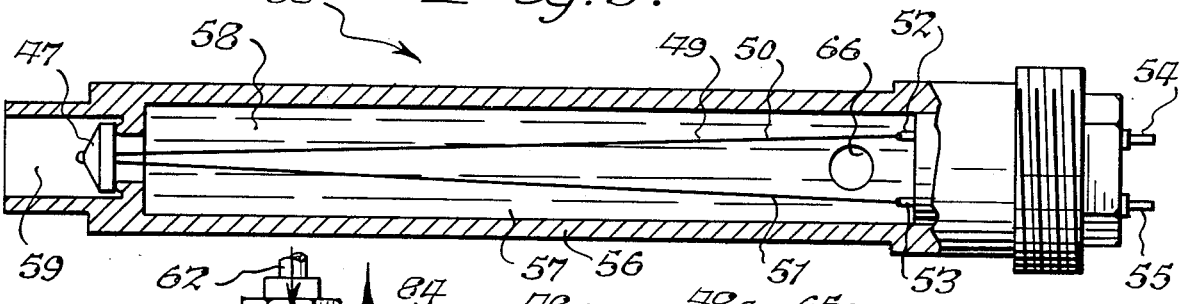
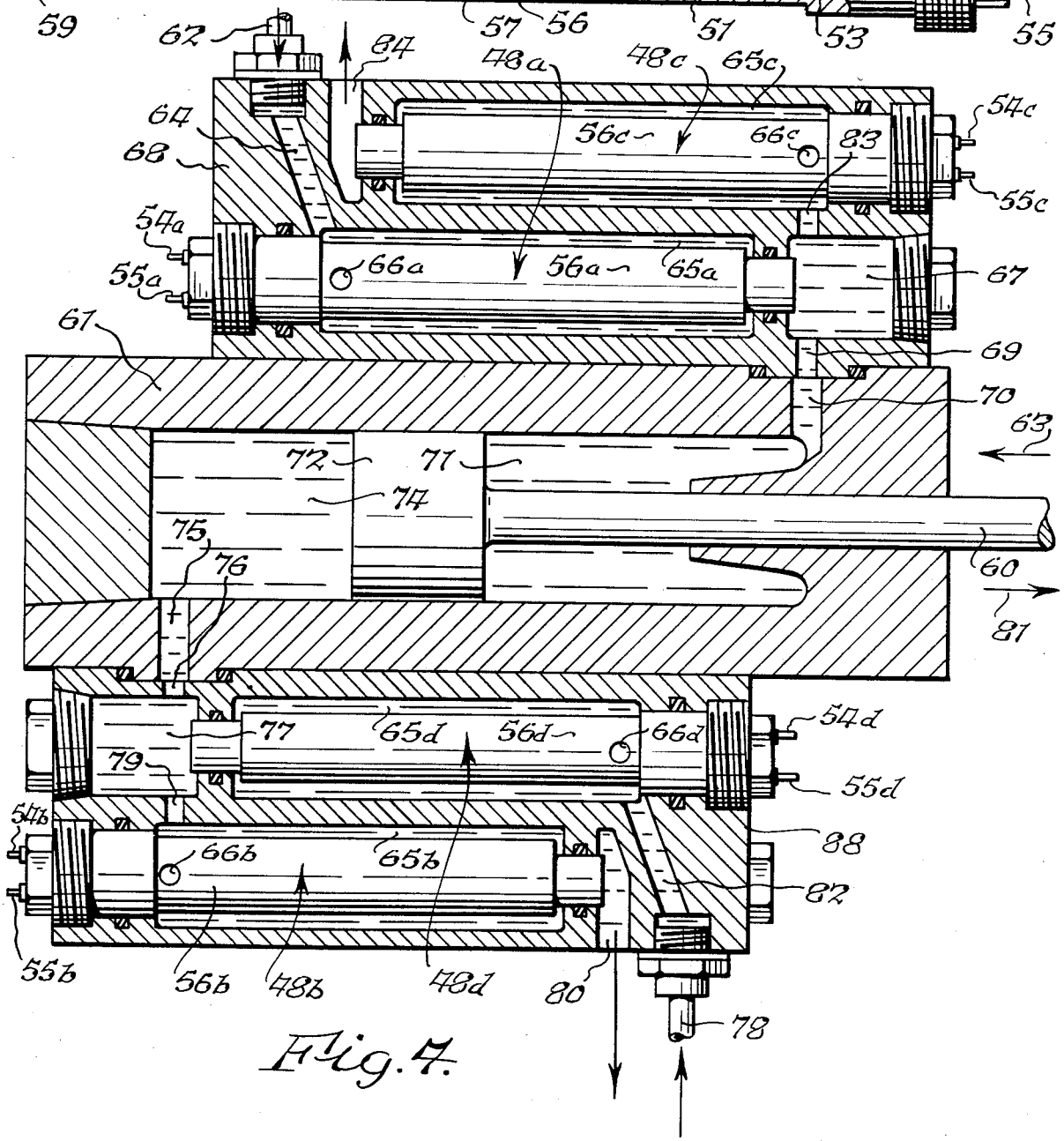
Fig. 4.

ELECTRICALLY OPERATED VALVE, PISTON AND CYLINDER ASSEMBLY INCORPORATING SAID VALVE, AND SELF-CONTAINED SYSTEM INCLUDING PRESSURIZED FLUID AND HYDRAULIC ACTUATOR

BACKGROUND OF THE INVENTION

The present invention relates to an electrically operated valve assembly, a piston and cylinder construction incorporating said valve assembly, and a self-contained system containing the latter which has a unique source of pressurized compressible liquid.

By way of background, in the past hydraulic actuators consisted of piston and cylinder assemblies which were provided with pressurized hydraulic fluid to move the piston in and out of the cylinder. These prior structures required an existing source of hydraulic fluid under pressure and they were used in conjunction with mechanical, hydraulic or electrically operated valves which were generally complex.

SUMMARY OF THE INVENTION

It is one object of the present invention to provide an improved electrically operated valve assembly which maintains a valve member on a seat by a tensioned member which can be expanded by heat to selectively permit the valve member to move off of its seat.

Another object of the present invention is to provide a wholly contained system of a hydraulic actuator and a source of pressurized fluid therefor in which compressible liquid is pressurized by a squib and this pressurized liquid is selectively conducted to a cylinder through a valve to move a piston out of the cylinder.

A further object of the present invention is to provide a two-way actuable piston in a cylinder wherein hydraulic fluid flow is conducted to opposite sides of the piston through electrically actuated valve assemblies wherein valve members are selectively moved from associated seats by the heating of a valve seating member therein.

Another object of the present invention is to provide a system utilizing a valve for controlling flow of pressurized compressible fluid, said valve being operated by heat which expands the compressible fluid thereby recovering the energy used for operating the valve.

Yet another object of the present invention is to provide a pressurized fluid system which will operate at high pressures, such as 9,000 to 30,000 psi, to thereby permit smaller volumes of pressurized fluids to generate substantial forces. Other objects and attendant advantages of the present invention will readily be perceived hereafter.

The present invention relates to an electrically actuated valve assembly for conducting fluid comprising a conduit, a seat on said conduit, a valve, a tensioned elongated member for retaining said valve on said seat, and heating means for heating said tensioned member to effect expansion thereof to permit said valve to move away from said seat.

The present invention also relates to a piston and cylinder construction comprising a housing, a cylinder in said housing, a piston in said cylinder, a chamber in said cylinder for receiving fluid, a conduit in said housing, a valve member in said conduit, a seat for receiving said valve member, retaining means for maintaining said valve member on said seat, and heating means for heating said retaining means to effect expansion thereof for permitting said valve member to move off of said seat to thereby effect communication between said conduit and said chamber.

The present invention also relates to a piston and cylinder construction comprising a cylinder, a piston in said cylinder, chambers in said cylinder on opposite sides of said piston, conduit means for conducting fluid to and from said chambers, a plurality of valve members in said conduit means, seats for said valve members, retaining means for retaining said valve members on said seats, and heating means for selectively heating said retaining means to permit said valve members to move off of said seats to thereby permit the flow of fluid to the chamber on one side of said piston while permitting the flow of fluid out of said chamber on the other side of said piston.

The present invention also relates to a system for moving a piston comprising a reservoir, compressible liquid in said reservoir, a squib, a cylinder, a chamber in said cylinder, a piston having one end portion in said chamber and its opposite end portion outside of said cylinder, compressible liquid in said reservoir, means for selectively firing said squib to compress said compressible liquid in said reservoir, conduit means between said reservoir and said chamber, valve means in said conduit means, and actuating means for selectively opening said valve means to selectively permit flow of compressible liquid from said reservoir to said chamber to thereby move said piston out of said cylinder.

The present invention also relates to an energy system comprising a housing, a compressible fluid in said housing, and means for generating pressurized gas and heat within said housing to compress and heat said compressible fluid.

The various aspects of the present invention will be more fully understood when the following portions of the specification are read in conjunction with the accompanying drawings wherein:

BRIEF DESCRIPTION OF THE DRAWINGS

FIG. 1 is a view partially in cross section of a system for providing pressurized fluid to an actuating cylinder which may be used in a directional control system or other environments;

FIG. 2 is a cross sectional view of the actuating cylinder shown in FIG. 1 and which incorporates a thermal valve;

FIG. 2A is a fragmentary side elevational view of another form of thermal actuating valve which may be used in the actuating cylinder of FIG. 2;

FIG. 2B is a fragmentary cross sectional view of still another form of thermal actuating valve using a plastic coated resistance wire which may be used in the actuating cylinder of FIG. 2;

FIG. 3 is a fragmentary cross sectional view of a thermally responsive valve assembly having still another form of thermal actuated valve; and FIG. 4 is a fragmentary cross sectional view of a double acting hydraulic actuator utilizing four thermally responsive valve assemblies of the type shown in FIG. 3 to effect movement in opposite directions.

DESCRIPTION OF THE PREFERRED EMBODIMENTS

The system of FIG. 1 includes a reservoir or housing 10, which is preferably spherical and which contains a compressible liquid 11 which normally fills chamber 12.

An explosive squib 13 is also located within chamber 12 and can be selectively energized through electrical conductor 14 so as to produce an explosion and thus, by filling the upper portion 15 of chamber 12 with gases, compress the compressible liquid within the lower portion of the chamber. The compressible liquid may be silicone liquid which is approximately 9.6% compressible at 20,000 pounds per square inch, or freon which is about 25% compressible at 20,000 pounds per square inch, or butane which is 20–25% compressible at 20,000 pounds per square inch, or any other suitable compressible liquid. The reservoir of the type shown in FIG. 1 is used in environments where pressurized liquid is required but an independent source of pressurized liquid does not exist.

A conduit 16 extends between reservoir 10 and actuator 17 which includes a cylinder 19 and a piston 20. The compressible liquid, under pressure, is in communication with chamber or conduit 21 of cylinder 19 through conduit 22. However, the liquid is confined to chamber 21 by valve member 23 which is seated on its associated seat and maintained in this condition by a tensioned wire 24 having one end attached to valve member 23 and the other end attached at 25 to screw member 26 which can be adjusted to vary the tension. A conductor 27 is connected to one end of wire 24 in the area 25, and a conductor 29 is connected to wire 24 through cap 30 and flexible wire 31.

When it is desired to cause the compressed liquid in chamber 21 to be placed in communication with the like compressible liquid in chamber 32, a voltage is applied across wires 27 and 29 to thereby heat tensioned wire 24 to cause it to expand which, in turn, permits valve member 23 to be moved off of its seat by the compressed liquid in chamber or conduit 21, and thus communication is established between the compressed liquid in chamber 21 and the liquid in chambr 32 through conduit 33. The heating of compressible fluid within conduit 21 will cause further expansion thereof, and thus the heat produced for expanding wire 24 will be recovered by the expansion of the compressible fluid. The increased pressure within chamber 32 will cause piston 20 to move out of cylinder 19 in the direction of arrow 34. Piston head 35, which is attached to the inner end of piston rod 20, merely serves to dampen piston movement and to guide the inner end of piston 20, considering that a bore 36 permits liquid on opposite sides of piston head 35 to be in restricted communication.

After the flow of current through wire 24 is terminated, the wire 24 will quickly return to its contracted condition wherein it pulls valve member 23 back onto its seat, to thereby terminate the flow of liquid from chamber 21 into chamber 32. The rapid cooling of wire 24 is obtained because of its immersion in silicone liquid which absorbs heat rapidly.

An alternate form of valve member is shown in FIG. 2A wherein valve head 39 and valve portion 40 comprise an integral high strength plastic filament member, such as Kevlar or Teflon, which is heated by an electrical conductor 41 surrounding stem 40. It will be appreciated that stem 40 is attached to a plug, such as 25 of FIG. 2. Another form of plastic valve and stem assembly 42 is shown in FIG. 2B wherein valve 43 is integral with stem 44 and a resistance heating wire 45 extends through stem 42 and head 43. The end of stem 42 may also be attached to a member such as 25 of FIG. 2. It will be appreciated that when heating elements 41 and 45 are energized, the plastic stems 40 and 44 will expand to permit the valve heads 39 and 43, respectively, to move off of their associated seats. The advantage of using plastic stems, rather than the wire 24 of FIG. 2, is that the plastic, which in filament form equals metal in strength, will expand much more from thermal inputs. Furthermore, the embodiment of FIG. 2B is extremely strong because of the metal core 45 within stem 42. It is contemplated that plastics which are both conductive and resistive could be both the resistor-heat element and the valve tensioning member.

In FIG. 3, another embodiment of a thermally responsive valve assembly 38 is described. Valve 47 is held onto its associated seat by resistance heating wire 49 which comprises lengths 50 and 51 connected to terminals 52 and 53, respectively, which are in electrical contact with terminals 54 and 55, respectively. Cylinder 56 contains compressible liquid 57 of the type described above, but it can contain incompressible liquid, as required for a particular application. It will readily be appreciated that whenever a suitable voltage is applied across terminals 54 and 55, wire 50 will be heated and will expand to permit valve 47 to become unseated to thereby permit the liquid 57 to flow into conduit 59 from chamber 58. Cylinder 56 contains a bore 66 through which liquid can flow into and out of cylinder 56.

The thermally responsive valve assembly described above relative to FIG. 3 can be used in pairs, as shown in FIG. 4, to drive piston rod 60 into and out of cylinder 61. Valve assemblies **48*a*, 48*b*, 48*c* and 48*d* of FIG. 4 are identical to each other and each contains the identical structure of valve assembly 48 described in detail relative to FIG. 3. The numerals with letter suffixes used in FIG. 4 represent structure which is identical to the structure of FIG. 3 which have like numerals without letter suffixes. The system shown in FIG. 4 includes a fluid inlet 62 which may be coupled to a suitable source of pressurized fluid or can be coupled to a reservoir, such as 10 of FIG. 1. Whenever it is desired to move piston rod 60 in the direction of arrow 63, the valve assemblies 48*a* and 48*b* are energized by applying suitable voltages across their terminals 54*a*–55*a* and 54*b*–55*b*, respectively, to expand wires 50 and 51 and thus permit unseating of valves 47 therein. This will cause flow of hydraulic fluid from conduit 62 through conduit 64, through chamber 65*a* in housing 68, into bore 66*a* of cylinder 56*a*, and through a valve, such as 47 (not shown) which is now open, into chamber 67, and through conduits 69 and 70 into chamber 71 to the right of piston head 72 which rides within cylinder 61. Simultaneously the fluid in chamber 74 will be exhausted through conduits 75 and 76, chamber 77, conduit 79, into chamber 65*b*, through bore 66*b*, into cylinder 56*b*, through a valve such as 47 therein (not shown) which is now open, into conduit 80, and to a reservoir (not shown). The foregoing can be effected because valve assemblies 48*c* and 48*d* have not been energized and therefore are closed and thus there can be no flow therethrough. After the voltage is no longer applied to terminals 54*a*–55*a* and 54*b*–55*b*, the wire 49 in valve assemblies 48*a* and 48*b* will contract to cause valves, such as 47 therein (not shown), to close thereby locking the fluid against movement out of chamber 71 and 74 to thereby hold piston rod 60** in postion in which it was last placed.

In the event it is desired to move piston rod 60 in the direction of arrow 81, valve assemblies **48*d* and 48*c*** are energized by applying voltages across terminals 54*d*–55*d* and 54*c*–55*c*, respectively. This will heat wires 50 and 51 therein to unseat valves 47 therein to permit flow of hydraulic fluid from conduit 78 into conduit 82 of housing 88, chamber 65*d*, through bore 66*d*, and into chamber 77 through the valve, such as 47, which is now open, through conduits 76 and 75 into chamber 74 of cylinder 73. Simultaneously, chamber 71 will be evacuated through conduits 70 and 69, chamber 67, conduit 83, chamber 65*c*, bore 66*c*, cylinder 56*c*, through the open valve, such as 47 within cylinder 56*c*, and through conduit 84 to the reservoir. After the application of voltage across terminals 54*c*–55*c* and 54*d*–55*d* has been terminated, the valves, such as 47 in cylinders 56*c* and 56*c*, will close to thereby terminate the flow of liquid into chamber 74 and out of chamber 71 to thereby lock piston 72 in position to terminate movement of piston rod 60 in the direction of arrow 81.

It can thus be seen that the electrically controlled hydraulic, pneumatic or gas cylinders, such as 17 (FIG. 2) and 61 (FIG. 4), can be actuated solely by electrically operated thermally responsive valves therein. Cylinder 17, as noted above, causes movement of piston 20 by the use of a compressible liquid in chamber 32 whereas in cylinder 61, piston rod 60 is moved in the conventional manner by supplying pressurized liquid to the chamber on one side of piston 72 while evacuating the chamber on the opposite side of piston 72. The liquid in the latter instance may be compressible or incompressible.

It should be noted that the present invention is primarily intended to be used, but not limited to, compressible fluids including silicone, liquid freon, butane, air or gas. All fluids and especially compressible fluids expand by heat so that most all the thermal energy expended in operating the internal resistance valve is recovered in the form of pressure energy in the system. This is in contrast to external solenoid valves which consume energy which is not recovered. It should also be noted that the thermal energy of the exploding squid in the accumulator is also largely recovered as the heat of the explosion results in the thermal expansion of the compressible fluid adjacent the explosion. It will also be readily appreciated that the various embodiments of the present invention can operate in the pressure range between about 9,000 and 30,000 psi, which, in turn, permits the various components, especially the cylinders, to be relatively small because the high pressure can produce forces of high magnitude.

While preferred embodiments of the present invention have been disclosed, it will be appreciated that the present invention is not limited thereto, but may be otherwise embodied within the scope of the following claims.

What is claimed is:

1. A system for moving a piston comprising a reservoir, compressible liquid in said reservoir, a squib, a cylinder, a chamber in said cylinder, a piston having one end portion in said chamber and its opposite end portion outside of said cylinder, compressible liquid in said chamber, means for selectively firing said squib to compress said compressible liquid in said reservoir, conduit means between said reservoir and said chamber, valve means in said conduit means, and actuating means for selectively opening said valve means to selectively permit flow of said compressed compressible liquid from said reservoir to said chamber to thereby move said piston out of said cylinder.

2. A system for moving a piston as set forth in claim 1 wherein said valve means comprises a valve member on a seat, a member for maintaining said valve member on said seat, and means to effect expansion of said member to effect movement of said valve means off of said seat.

3. A system for moving a piston as set forth in claim 2 wherein said member is an electrical wire, and wherein said means for effecting expansion of said member comprises means for passing electrical current through said member.

4. A system for moving a piston as set forth in claim 1 wherein said cylinder is located in a housing, and wherein a portion of said conduit means is also located in said housing.

5. A system for moving a piston as set forth in claim 4 wherein said valve means is also located in said housing.

6. A system for moving a piston as set forth in claim 5 wherein said valve means comprises a valve member on a seat, a member for maintaining said valve member on said seat, and means to effect expansion of said member to effect movement of said valve member off of said seat.

7. A system for moving a piston as set forth in claim 1 wherein said cylinder is located in a housing, and wherein said conduit means comprises a conduit in said housing, and wherein said valve means in said conduit means comprises a valve member in said conduit, a seat for receiving said valve member, retaining means for retaining said valve member on said seat, and wherein said actuating means comprises heating means for heating said retaining means to effect expansion thereof for permitting said valve means to move off of said seat to thereby effect communication between said conduit and said chamber, said retaining means comprising an electrical wire, and said heating means comprising means for conducting electrical current to said wire.

8. A system for moving a piston as set forth in claim 1 wherein said conduit means comprises a conduit, and wherein said valve means includes a valve and a seat on said conduit, a tensioned elongated member for retaining said valve on said seat, said tensioned elongated member comprising an electrical wire, and wherein said actuating means comprises heating means for heating said tensioned elongated member to effect expansion thereof to permit said valve to move away from said seat, and wherein said tensioned elongated member is in said conduit, and wherein said compressible fluid is also in said conduit, said compressible fluid being heated by said heating means to thereby expand said compressible fluid in said conduit and raise the pressure thereof incidental to effecting expansion of said tensioned elongated member.

9. A system for moving a piston as set forth in claim 1 wherein said reservoir comprises a housing, and wherein said compressible fluid is in said housing, and wherein said squib comprises means for generating pressurized gas and heat within said housing to compress and that said compressible fluid, and wherein said conduit means comprises a conduit for receiving said compressible fluid, and wherein said valve means comprises a valve and a seat for said valve, and wherein said actuating means comprises tensioned means in said conduit for maintaining said valve on said seat and means for applying electrical heat to said tensioned means to both effect expansion thereof to permit said pressurized fluid to move said valve off of said seat and also heat said fluid in said conduit to further expand said fluid, said tensioned means comprising an electrical resistor.

* * * * *

UNITED STATES PATENT AND TRADEMARK OFFICE

CERTIFICATE OF CORRECTION

PATENT NO. : 4,548,041

DATED : October 22, 1985

INVENTOR(S) : Paul H. Taylor

It is certified that error appears in the above-identified patent and that said Letters Patent are hereby corrected as shown below:

Column 6, line 57 (claim 9), change "that" to read --heat--.

Signed and Sealed this

*Twenty-fourth* Day of *December 1985*

[SEAL]

*Attest:*

DONALD J. QUIGG

*Attesting Officer*

*Commissioner of Patents and Trademarks*